US008810472B2

(12) United States Patent
Wendisch et al.

(10) Patent No.: US 8,810,472 B2
(45) Date of Patent: Aug. 19, 2014

(54) ANTENNA MODULE FOR PRODUCING A TRANSPONDER, AND A TRANSPONDER

(75) Inventors: Jan Wendisch, Salzkotten (DE); Egon Konopitzky, Chatel-St-Denis (CH)

(73) Assignee: Smartrac IP B.V. (NL)

( * ) Notice: Subject to any disclaimer, the term of this patent is extended or adjusted under 35 U.S.C. 154(b) by 688 days.

(21) Appl. No.: 13/063,343

(22) PCT Filed: Jul. 20, 2009

(86) PCT No.: PCT/EP2009/005235

§ 371 (c)(1),
(2), (4) Date: Mar. 10, 2011

(87) PCT Pub. No.: WO2010/028716

PCT Pub. Date: Mar. 18, 2010

(65) Prior Publication Data

US 2011/0169702 A1 Jul. 14, 2011

(30) Foreign Application Priority Data

Sep. 11, 2008 (DE) ..... 10 2008 047 013

(51) Int. Cl.
*H01Q 7/00* (2006.01)
*H01Q 1/22* (2006.01)

(52) U.S. Cl.
CPC ..... *H01Q 1/2225* (2013.01); *H01Q 7/00* (2013.01)
USPC ..... 343/866

(58) Field of Classification Search
USPC ..... 343/866, 869, 870, 871; 340/572.7
See application file for complete search history.

(56) References Cited

U.S. PATENT DOCUMENTS

2005/0130389 A1* 6/2005 Yamazaki et al. ..... 438/455

FOREIGN PATENT DOCUMENTS

| | | | |
|---|---|---|---|
| DE | 100 52 517 | A1 | 2/2002 |
| EP | 1 755 069 | A | 2/2007 |
| JP | 07 335443 | A | 12/1995 |
| JP | 2002 366917 | A | 12/2002 |
| JP | 2003 022912 | A | 1/2003 |

OTHER PUBLICATIONS

The International Search Report as mailed on Nov. 5, 2009 for International Application No. PCT/EP2009/005235.
English Translation of the PCT International Preliminary Report on Patentability, International Application No. PCT/EP2009/005235, mailed Mar. 24, 2011.

* cited by examiner

*Primary Examiner* — Robert Karacsony
(74) *Attorney, Agent, or Firm* — Quarles & Brady LLP

(57) ABSTRACT

The present invention relates to an antenna module (45) for producing a transponder, wherein the antenna module comprises an antenna conductor arrangement disposed on a substrate surface (46) of a substrate (47) and having an antenna conductor (50) for contacting with a chip (40), wherein the antenna conductor (50) forms a first antenna part (51) having a first terminal end on a first partial area (48) of the substrate surface, and with a second terminal end extends to a second partial area (49) of the substrate surface to form a second antenna part (52), wherein antenna connection contacts (57, 61) are disposed on the respective partial areas, such that the antenna connection contacts can be brought into an overlapping position for producing an electrically conductive connection by swiveling the partial areas with respect to each other.

19 Claims, 4 Drawing Sheets

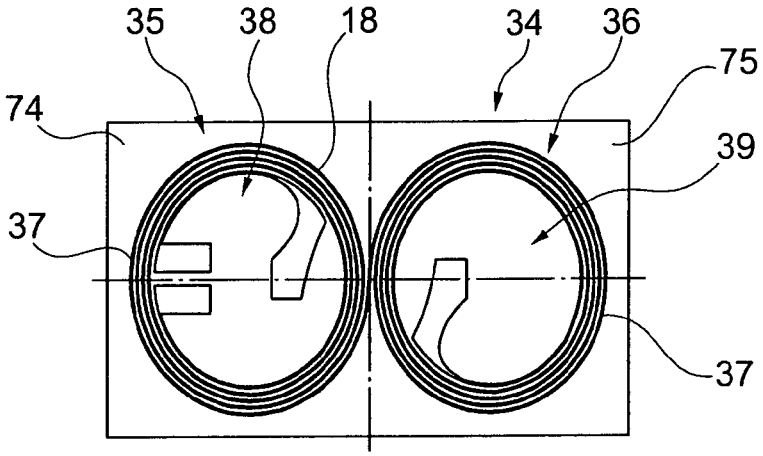
Fig. 3
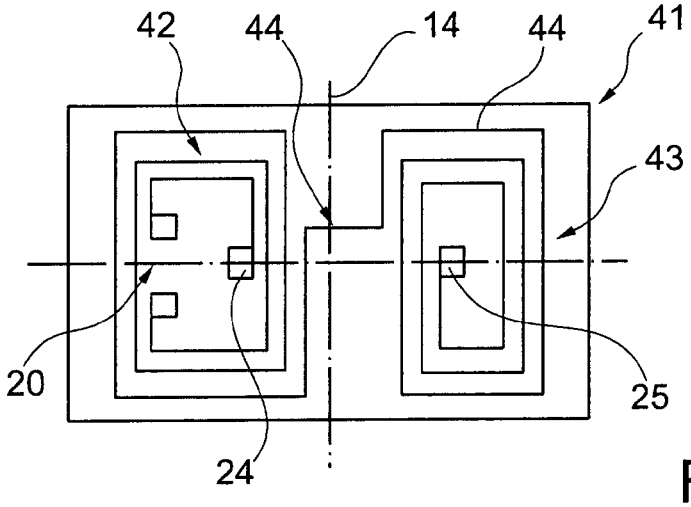
Fig. 4
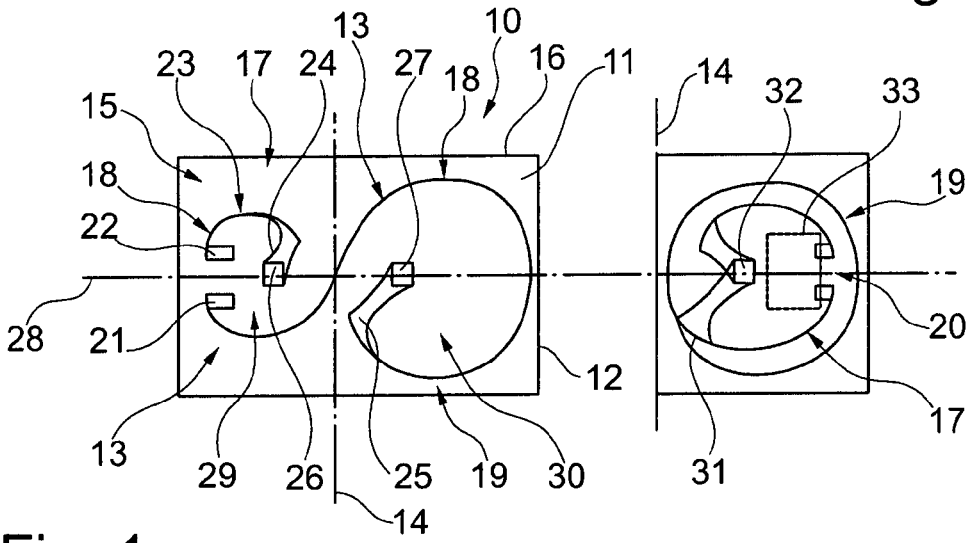
Fig. 1
Fig. 2

ANTENNA MODULE FOR PRODUCING A TRANSPONDER, AND A TRANSPONDER

CROSS-REFERENCE TO RELATED APPLICATIONS

The present application claims the benefit of German Patent Application No. DE 10 2008 047 013.9 filed Sep. 11, 2008, and is a national stage application of PCT International Application No. PCT/EP2009/005235 filed on Jul. 20, 2009, both applications are incorporated herein by reference.

The present invention relates to an antenna module for producing a transponder, wherein the antenna module features an antenna conductor arrangement disposed on a substrate surface of a substrate and having an antenna conductor for contacting with a chip. Moreover, the invention relates to a transponder having such an antenna module.

From document DE 100 52 517 A1 an antenna module is known which features an antenna conductor arrangement disposed on a substrate surface of a substrate for contacting with a chip. The antenna conductor arrangement features an antenna conductor extending longitudinally to the edges of the substrate on the substrate surface to produce a transponder antenna and forming a first and a second terminal end respectively at an inner and an outer winding end, said terminal ends serving for contacting with the chip. Since the terminal ends are disposed on opposing sides of the antenna conductor arrangement, direct contacting with terminal faces of the chip is not possible. To remedy this aspect, a foldable contacting lug is provided in the inner region of the antenna conductor arrangement which, where appropriate, subsequent to contacting with the chip makes it possible to easily produce a contact bridge between the terminal ends of the antenna conductor arrangement. In particular in the instance where the contact bridge serves for the preceding contacting with the chip, a type of housed arrangement is realized at least for the chip. However, if the antenna module known from the state of the art is used for producing a transponder, it is necessary to furnish the antenna module at least on its substrate surface, on which the antenna conductor arrangement is disposed, with a cover layer to be able to realize a completely housed transponder configuration, which as a rule constitutes a prerequisite for use of the transponder in practical applications.

It is an object of the present invention to suggest an antenna module which enables the production of a transponder and in particular the formation of a housed transponder arrangement in the easiest possible manner. Moreover, it is an object of the present invention to suggest a transponder which can be produced in a particularly easy manner and which is hermetically sealed especially in the simplest design thereof.

To achieve this object the inventive antenna module exhibits the features of claim 1.

According to the invention, the antenna conductor arrangement features an antenna conductor, which on a first partial area of the substrate surface forms a first antenna part having a first terminal end, and which with a second terminal end extends to a second partial area of the substrate surface to form another antenna part, wherein the first terminal end of the first antenna part forms a first contact device which forms a terminal face arrangement jointly with an adjacently arranged second contact device for contacting with the chip, wherein the second contact device features a first antenna connection contact and the terminal end of the second antenna part forms a second antenna connection contact, wherein the antenna connection contacts are disposed on the respective partial areas such that the antenna connection contacts can be brought into an overlapping position for producing an electrically conductive connection between the antenna connection contacts by swiveling the partial areas with respect to each other.

Thus, the antenna module designed according to the invention on the one hand enables the simple formation of a contact bridge between the terminal ends of the antenna conductor arrangement and at the same time enables a housed arrangement of the transponder antenna, respectively the antenna conductor arrangement, as a result of swiveling the partial areas having the antenna parts disposed thereon with respect to each other. Thus, the antenna module exhibiting the inventive design provides the prerequisite for realizing a housed arrangement with minimal expenditure of components. In particular, the application of a separately handable covering substrate onto an antenna conductor arrangement formed on the surface of the antenna substrate beforehand can be dispensed with. Moreover, starting from an originally planar formation of the antenna conductor arrangement, swiveling of the antenna parts with respect to each other makes it possible to achieve a spatial antenna conductor arrangement which enables a significant increase in conductor density and thus a corresponding increase in the inductance of the coil unit, respectively the transponder antenna formed by the conductor arrangement.

If, according to a particularly preferred embodiment, the antenna connection contacts of the antenna parts are each disposed in an inner region of the antenna parts, which is limited by the antenna conductor, a comparatively large area for forming the antenna connection contacts is available without thereby necessitating an enlargement of the outer dimensions of the antenna conductor arrangement.

If the antenna connection contacts are each disposed equidistantly to a swivel axis which separates the partial areas from each other, on a contact axis extending perpendicularly to the swivel axis, a positionally accurate contacting of the antenna connection contacts is enabled in a particularly simple fashion.

The formation of a particularly compact transponder arrangement is enabled if the antenna connection contact of the first antenna part is disposed adjacent to the swivel axis and between the swivel axis and the terminal face arrangement, since in this way, a sufficiently large accommodating space for the arrangement of a chip to be contacted with the terminal face arrangement is enabled likewise in the inner region, which is limited by the antenna conductor, of the first antenna part, respectively the antenna conductor arrangement.

In particular for increasing the inductance of the antenna conductor arrangement formed by the two antenna parts it is advantageous if at least one antenna part features an antenna conductor which is disposed in a plurality of windings.

It is particularly advantageous if both the first and the second antenna part feature an antenna conductor which is disposed in a plurality of windings.

A positioning of the antenna connection contact of the first antenna part which is readily variable as regards the geometry thereof and which can thus be easily adapted to the respective spatial requirements is enabled if the antenna connection contact of the first antenna part is connected to a contact device of the terminal face arrangement via an antenna conductor part.

Depending on the arrangement of the antenna conductor on the partial areas of the substrate surface and the overlapping region or else the contact region of the antenna conductor of the antenna parts resulting from the swiveling of the partial areas with respect to each other, the antenna conductor essentially can be completely or else partially covered by an electrical insulation.

If, according to an advantageous embodiment, the antenna conductor of the first antenna part and the antenna conductor of the second antenna part are designed in the form of a capacitor plate at least in sections, such that the capacitor plates can be brought into an overlapping position to form a plate capacitor by swiveling the partial areas with respect to each other, it is possible to readily integrate a capacitor function without for this purpose necessitating a separately formed component. Instead, even one and the same antenna conductor may serve both for forming the antenna and equally for forming a capacitor.

If, besides, the overlapping position of the capacitor plates is only partially realized, the option to trim the capacitor in a simple manner is available by relatively positioning the capacitor plates such that they are deliberately offset with respect to each other.

A significant advantage of the inventive design of the antenna module is provided by the aspect that the antenna conductor can basically be provided by any optional conductor path structure type which is applied to the substrate surface. In this regard, in particular for forming particularly flat, respectively thin, antenna modules it proves to be advantageous to form the conductor path structure by coating the substrate surface with a metallization.

This applies in particular in the instance where a relatively large configuration of the antenna module is intended to be realized. For producing a correspondingly large transponder which is dimensioned so as to exhibit a high capacity, it may be advantageous if the conductor path structure is formed by a wire conductor which is applied to the substrate surface.

If, according to another possible embodiment, the antenna conductor arrangement, in addition to the first antenna part, features a plurality of antenna parts which are disposed on the substrate surface of the substrate on respectively adjacent partial areas of the substrate surface and which feature antenna connection contacts for contacting with the first and the second antenna part such that the antenna connection contacts can be brought into an overlapping position for producing an electrically conductive connection between the antenna connection contacts by swiveling the partial areas with respect to each other in a Leporello-like manner, the number of windings of the antenna coil formed by the antenna conductor arrangement can be increased in highly compact spaces, and the antenna characteristics and in particular the efficiency can be determined for instance by a correspondingly selected number of partial areas.

To attain the object underlying the invention, the inventive transponder exhibits the features of claim 15.

According to the invention, the transponder arrangement comprises a chip having chip terminal faces which are contacted with the terminal face arrangement disposed on the first partial area of the substrate surface.

In this regard, it is particularly advantageous if the chip itself is also disposed on the first partial area of the substrate surface such that both the production of the antenna conductor arrangement and the subsequent contacting of the chip with the antenna conductor arrangement can be performed on one and the same substrate surface, i.e. can be performed from one side. Hence, the chip can be directly contacted with the terminal face arrangement in the manner of a flip-chip contacting.

If the chip is disposed between the partial areas of the substrate surface in a sandwich-like manner to form a housed transponder arrangement having antenna conductor connection contacts which are contacted with each other, i.e. having partial areas of the substrate surface which are swiveled with respect to each other, the formation of a housed transponder arrangement is enabled with minimal effort and a minimum number of components. In particular, the housed arrangement of the chip in the transponder arrangement is enabled without necessitating the use of a separately handable cover layer or the like for covering the chip.

A transponder hermetically sealed in this manner is suitable for use in medical engineering or material analysis and can be used for instance in liquids, such as in particular body fluids.

If, besides, the chip is accommodated in the inner region of the antenna conductor arrangement which is formed by the first antenna part and the second antenna part, the chip is arranged in such a manner that the antenna conductor arrangement peripherally surrounding the chip acts as an outer annular stiffening for the chip, respectively the contact region of the chip having the terminal face arrangement.

An accommodation of the chip offering not only mechanical stabilization but also permanent hermetical sealing is enabled if the partial areas are connected with each other in a hermetically sealed manner in a peripheral region surrounding the antenna conductor arrangement and the chip. This can be performed, in particular depending on the material properties of the substrate, by using an adhesive bonding or else a welding process.

Preferred embodiments of the invention will be explained in greater detail with reference to the drawings.

In the drawings:

FIG. 1 shows an antenna module in a first embodiment in a planar arrangement;

FIG. 2 shows the antenna module depicted in FIG. 1 in a swiveled arrangement swiveled about a swivel axis;

FIG. 3 shows an antenna module in a planar arrangement according to another embodiment;

FIG. 4 shows an antenna module in a planar arrangement according to another embodiment;

Figure 5:
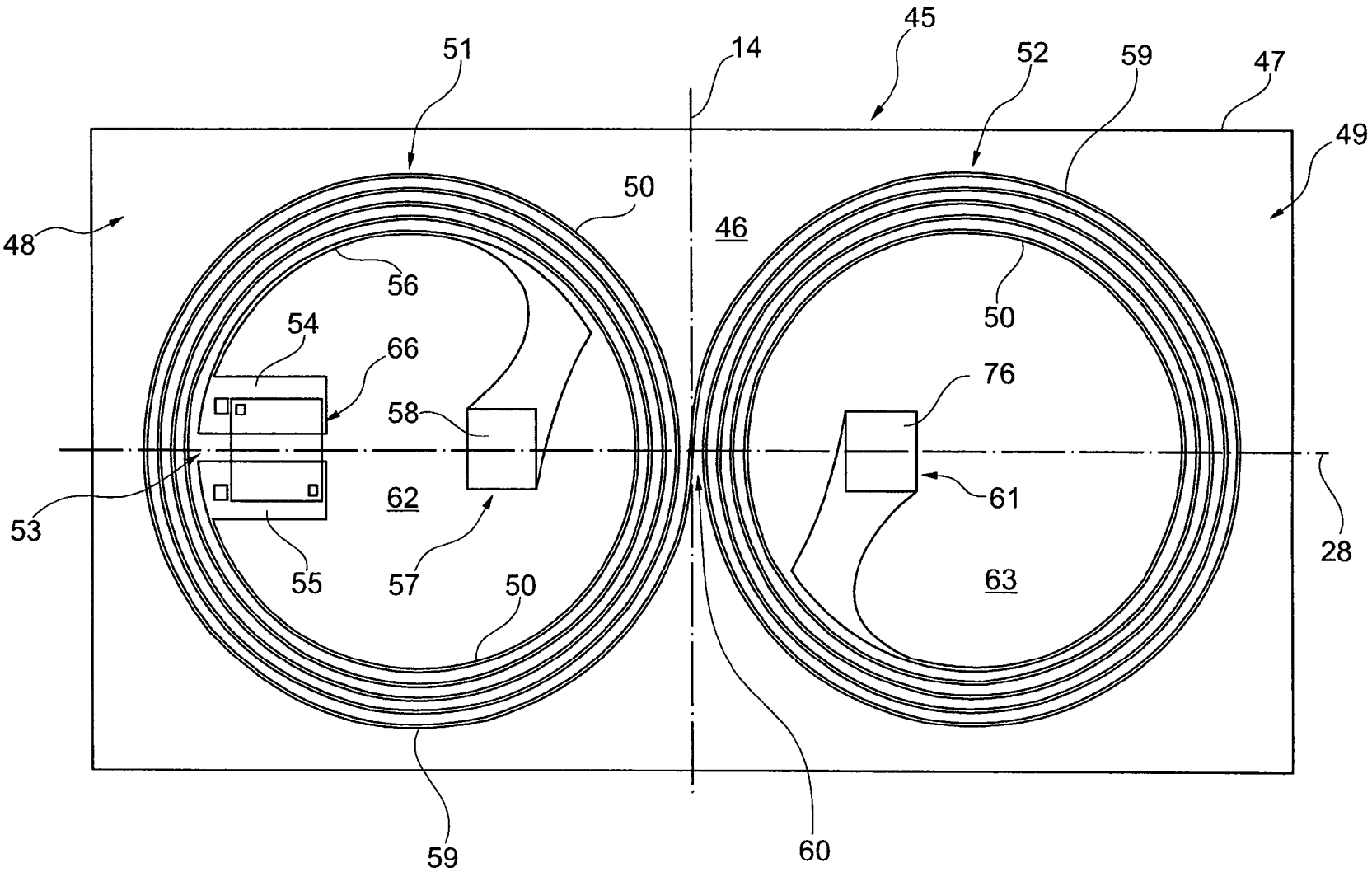
FIG. 5 shows an antenna module in a planar arrangement in another embodiment.

FIG. 1 shows an antenna module 10 having an antenna conductor arrangement 13 disposed on a substrate surface 11 of a substrate 12. The substrate surface 11 is divided into a first partial area 15 and a second partial area 16 by a swivel axis 14. On the first partial area 15, a first antenna part 17 is disposed, which features an antenna conductor 18 extending from partial area 15 to partial area 16 and here forming a second antenna part 19.

The first antenna part 17 features a terminal face arrangement 20 having a first contact device 21 and a second contact device 22. The second contact device 22 is provided with a first antenna connection contact 24 while being connected via an antenna conductor part 23. The second antenna part 19 at the free end thereof features a second antenna connection contact 25. The antenna connection contacts 24, 25 with the contact faces 26, 27 being formed their ends are disposed on a contact axis 28 which is disposed perpendicularly to the swivel axis 14, wherein the contact faces 26, 27 are arranged equidistantly with respect to the swivel axis 14.

In the exemplary embodiment depicted in FIG. 1, the antenna connection contacts 24, 25 and the contact faces 26, 27 are each disposed in an inner region 29, 30 of the antenna parts 17, 19, wherein the inner region 29, 30 is respectively limited by the antenna conductor 18.

As can be seen from FIG. 2, the inner region 30 of the second antenna part 19 is dimensioned such that the first antenna part 17 is accommodated in the inner region 30 when the first partial area 15 is swiveled about the swivel axis 14 with respect to the second partial area 16, whereby adjacent to the swivel axis 14, an overlapping region 31 is realized between the first antenna part 17 and the second antenna part 19. Moreover, it is apparent that a contact covering 32 which enables an electrically conductive contacting between the first antenna part 17 and the second antenna part 19 is realized as a result of the equidistant arrangement of the contact faces 26, 27 with respect to the swivel axis 14.

As is also displayed in FIG. 2, an accommodating space 33 is produced between the contact covering 32 and the terminal face arrangement 20 due to the adjacent arrangement of the contact face 26, 27, respectively the antenna connection contact 24, 25 with respect to the swivel axis 14, said accommodating space enabling the arrangement of a chip 40 being depicted in FIG. 2 using dash-dotted lines in the inner region 29, respectively 30.

In the folded configuration illustrated in FIG. 2 of the antenna module 10 having antenna connection contacts 24, 25 of the antenna parts 17 and 19, which are contacted with each other in the region of the contact covering 32, the antenna conductor arrangement 13 forms a transponder antenna which, in order to form a functional transponder, only needs to be contacted with a chip 40 being disposed in the accommodating space 33 via the contact devices 21, 22 of the terminal face arrangement 20.

FIG. 3 shows an antenna module 34 which, in contrast to the antenna module 10 illustrated in FIG. 1, is provided with a first antenna part 35 and a second antenna part 36, each having several antenna windings 37 of the antenna conductor 18 and which are otherwise provided with a terminal face arrangement 20 and antenna connection contacts 24, 25 in conformity with the antenna part 17 and the antenna part 19 of the antenna module 10.

In contrast to the antenna module 10 illustrated in FIGS. 1 and 2, the antenna parts 35, 36 essentially feature inner regions 38, 39 of equisized dimensions, wherein the antenna windings 37 are spaced apart from each other at a constant distance. This results in the antenna parts 35, 36 being disposed so as to overlap with the antenna conductor 18 when the partial areas 74, 75, respectively the antenna parts 35, 36, are swiveled with respect to each other according to FIG. 2, so that an insulation (not illustrated here in greater detail) of the antenna conductor 18 is necessary. By contrast, in the exemplary embodiment illustrated in FIG. 2, for technical reasons insulation is only necessary in the overlapping region 31.

FIG. 4 in another embodiment illustrates an antenna module 41 in which, in contrast to the antenna module 34 illustrated in FIG. 3, the antenna parts 42, 43 do not feature circularly concentrically arranged antenna windings 37 but rather rectangularly extending antenna windings 44, which in the region of the swivel axis 14 are connected to each other via an antenna conductor part 44 being configured in a step-like manner. Apart from that, the antenna module 41 illustrated in FIG. 4, in conformity with the antenna modules 10 and 34 illustrated in FIGS. 1, 2 and 3, is provided with a terminal face arrangement 20 formed at the first antenna part 42 and is provided with antenna connection contacts 24, 25 formed at the first antenna part 42, respectively the second antenna part 43, such that the antenna module 41 illustrated in FIG. 4 can also be transferred into a folded configuration corresponding to the illustration in FIG. 2, in which the antenna connection contacts 24, 25 are disposed in an overlapping position and can be contacted with each other.

FIG. 5 shows an antenna module 45 which on a substrate surface 46 of a substrate 47 features partial areas 48 and 49 being separated from each other by a swivel axis 14, in which a first antenna part 51 and a second antenna part 52 each formed by an antenna conductor 50 are disposed.

The antenna conductor 50 and the antenna parts 51 and 52 in the case of the illustrated exemplary embodiment are composed of a metallization applied to the substrate surface 46 for instance using a deposition process.

The antenna part 51 features a terminal face arrangement 53 having a first contact device 54 and a second contact device 55. The contact device 54 features a first antenna connection contact 57 being connected via an antenna conductor part 56 and extending into an inner region 62 of the antenna part 51, and a contact face 58 thereof being disposed on a contact axis 28 extending perpendicularly to the swivel axis 14. The contact device 55 is formed by a free terminal end of the antenna conductor 50 being disposed on the partial area 48 in a circularly spiraled manner to form the antenna part 51. The antenna conductor 50 in the case at hand firstly describes left-turning antenna windings 59 before changing its winding sense at a transition point 60 disposed on the swivel axis 14 and being transferred on the partial area 49 into right-turning antenna windings 59 which are equally disposed in a circularly spiraled manner, and the free terminal end thereof forming an antenna connection contact 61 which extends into an inner region 63 of the antenna part 52 and the contact face 76 thereof being disposed on the contact axis 28.

Figure 6:
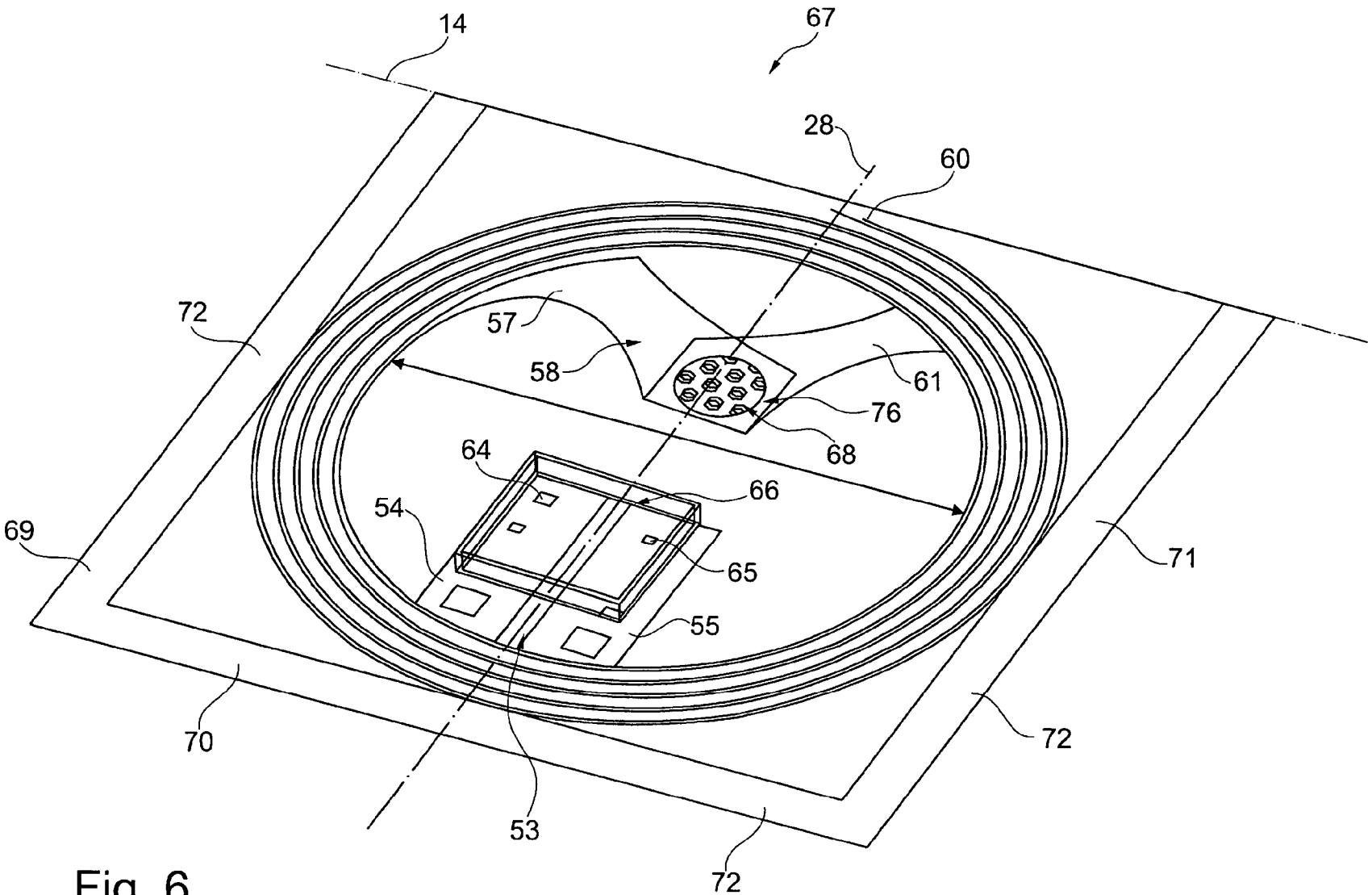
FIG. 6 shows the antenna module depicted in FIG. 5 in a swiveled arrangement swiveled about a swivel axis.
Figure 7:
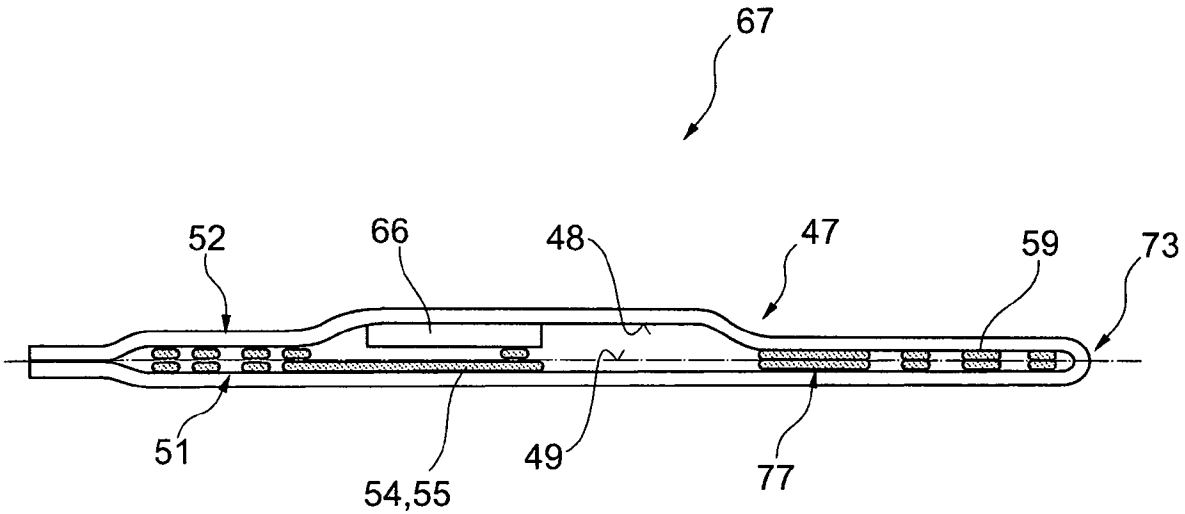
FIG. 7 shows a housed transponder arrangement using the antenna module depicted in FIGS. 5 and 6.

For producing a transponder 67 illustrated in FIGS. 6 and 7, the contact devices 54 and 55 of the terminal face arrangement 53 of the first antenna part 51 (FIG. 5) are contacted with terminal faces 64, 65 of a chip 66. Here, the chip 66 is disposed on the contact devices 54, 55 using flip-chip technology. Moreover, for producing the housed transponder 67 illustrated in FIGS. 6 and 7, the partial faces 48, 49 of the substrate 47 are folded or else swiveled with respect to each other resulting in the contact faces 58 and 76 of the antenna connection contacts 57 and 61 being brought into an overlapping position (FIG. 6), wherein an electrically conductive connection can be produced in a connection region 68. This connection can be realized for instance by thermal compression, the application of ultrasound, mechanical deformation or else adhesive bonding.

Depending on the design of the material selected for the substrate 47, at least the outer edges 69, 70 and 71 not converging with the swivel axis 14 can be hermetically connected with each other, for instance using a hot-sealed joint or adhesive bonding.

FIG. 7 illustrates the transponder 67 depicted in FIG. 6 in a cross-sectional view longitudinally to the contact axis 28. Here, it is clearly apparent that the chip 66, which is contacted with the contact devices 54, 55 of the first antenna part 51, is accommodated between the partial areas 48, 49 of the substrate 47 so as to be housed there between. As a consequence of folding or swiveling the partial faces 48, 49 with respect to each other, a folding edge 73 is formed at the left edge of the transponder module 67 in FIG. 7, which jointly with the hot-sealed joints 72 formed at the remaining outer edges 69, 70, 71 (FIG. 6) provides for an overall hermetically sealed accommodation of the chip 66 and also of an antenna conductor arrangement 77 formed by the antenna parts 51, 52. In the exemplary embodiment illustrated in FIGS. 5 to 7 of the antenna conductor arrangement 77, besides, an overlap is obtained between the antenna windings 59 of the first antenna part 51 and the second antenna part 52, such that in the present exemplary embodiment, an insulation should be formed between the antenna parts 51, 52 which may be formed by a baked enamel coating or the like.

The invention claimed is:

1. An antenna module for producing a transponder, said antenna module comprising:

a substrate having a substrate surface;

an antenna conductor arrangement disposed on the substrate surface of the substrate said antenna conductor arrangement having an antenna conductor for contacting with a chip, said antenna conductor including a first antenna part and a second antenna part, said first antenna part having a first terminal end on a first partial area of the substrate surface, and said second antenna part having a second terminal end on a second partial area of the substrate surface, wherein the first terminal end of the first antenna part forms a first contact device which forms a terminal face arrangement jointly with an adjacently arranged second contact device for contacting with the chip, wherein the second contact device features a first antenna connection contact and the terminal end of the second antenna part forms a second antenna connection contact, wherein the antenna connection contacts are disposed on the respective partial areas such that the antenna connection contacts can be brought into an overlapping position for producing an electrically conductive connection between the antenna connection contacts by swiveling the partial areas with respect to each other, and wherein the antenna connection contacts of the antenna parts are each disposed in an inner region of the antenna parts, which is limited by the antenna conductor.

2. The antenna module according to claim 1, in which the antenna connection contacts are each disposed equidistantly with respect to a swivel axis, which separates the partial areas from each other, on a contact axis extending perpendicularly with respect to the swivel axis.

3. The antenna module according to claim 2, in which the antenna connection contact of the first antenna part is disposed adjacent to the swivel axis and between the swivel axis and the terminal face arrangement.

4. The antenna module according to claim 1, in which at least one antenna part features the antenna conductor in a plurality of antenna windings.

5. The antenna module according to claim 4, in which the first and the second antenna parts feature the antenna conductor in a plurality of antenna windings.

6. The antenna module according to claim 1, in which the antenna connection contact of the first antenna part is connected to a contact device of the terminal face arrangement via an antenna conductor part.

7. The antenna module according to claim 1, in which the antenna conductor is provided with an electrical insulation at least in sections.

8. The antenna module according to claim 1, in which the antenna conductor of the first antenna part and the antenna conductor of the second antenna part are designed as a capacitor plate at least in sections, such that the capacitor plates can be brought into an overlapping position to form a plate capacitor by swiveling the partial areas with respect to each other.

9. The antenna module according to claim 8, in which the overlapping position of the capacitor plates is only partially realized, such that the capacitor plates are disposed in the plate plane so as to be offset with respect to each other.

10. The antenna module according to claim 1, in which the antenna conductor is formed by a conductor path structure applied to the substrate surface.

11. The antenna module according to claim 10, in which the conductor path structure is formed by coating the substrate surface with a metallization.

12. The antenna module according to claim 10, in which the conductor path structure is formed by a wire conductor applied to the substrate surface.

13. The antenna module according to claim 1, in which the antenna conductor arrangement in addition to the first antenna part features a plurality of antenna parts which are disposed on the substrate surface of the substrate on respectively adjacent partial areas of the substrate surface and which feature antenna connection contacts for contacting with the first and the second antenna part, such that the antenna connection contacts can be brought into an overlapping position for producing an electrically conductive connection between the antenna connection contacts by swiveling the partial areas with respect to each other in an accordian-like manner.

14. A transponder having an antenna module according to claim 1, comprising a chip having terminal faces which are contacted with the terminal face arrangement disposed on the first partial area of the substrate surface.

15. The transponder according to claim 14, in which the chip is disposed on the first partial area of the substrate surface.

16. The transponder according to claim 15, in which the chip is accommodated between the partial areas of the substrate surface in a sandwich-like manner for forming a housed transponder arrangement having antenna connection contacts which are contacted with each other.

17. The transponder according to claim 16, in which the chip is accommodated in the inner region of the antenna conductor arrangement, which is formed by the first antenna part and the second antenna part.

18. The transponder according to claim 16, in which the partial areas are connected to each other in a hermetically sealed fashion in a peripheral region surrounding the antenna conductor arrangement and the chip.

19. The transponder according to claim 18, in which the partial areas are adhesively bonded or else welded to each other.

* * * * *